US010940919B2

(12) United States Patent
Rooke

(10) Patent No.: US 10,940,919 B2
(45) Date of Patent: Mar. 9, 2021

(54) LIGHTWEIGHT SEA ANCHOR SYSTEM

(71) Applicant: WOMEN AT WORK GROUP PTY LTD, Dingley (AU)

(72) Inventor: Greg Rooke, Dingley (AU)

(73) Assignee: WOMEN AT WORK GROUP PTY LTD, Dingley (AU)

( * ) Notice: Subject to any disclaimer, the term of this patent is extended or adjusted under 35 U.S.C. 154(b) by 0 days.

(21) Appl. No.: 16/334,883

(22) PCT Filed: Sep. 20, 2017

(86) PCT No.: PCT/AU2017/051025

§ 371 (c)(1),
(2) Date: Mar. 20, 2019

(87) PCT Pub. No.: WO2018/053586

PCT Pub. Date: Mar. 29, 2018

(65) Prior Publication Data

US 2020/0017171 A1 Jan. 16, 2020

(30) Foreign Application Priority Data

Sep. 20, 2016 (AU) ..... 2016903795

(51) Int. Cl.
*B63B 21/48* (2006.01)

(52) U.S. Cl.
CPC ..... *B63B 21/48* (2013.01)

(58) Field of Classification Search
CPC ..... B63B 21/48
See application file for complete search history.

(56) References Cited

U.S. PATENT DOCUMENTS 4,473,256 A * 9/1984 Collins ..... E02B 17/024 173/28
6,041,730 A * 3/2000 Oliverio ..... B63B 21/26 114/230.13
7,971,548 B2 * 7/2011 Kuenzel ..... B63B 21/26 114/294
8,550,023 B1 * 10/2013 Quail ..... B63B 21/26 114/294
8,800,465 B1 * 8/2014 Quail ..... B63B 21/26 114/294

(Continued)

*Primary Examiner* — Lars A Olson
*Assistant Examiner* — Jovon E Hayes
(74) *Attorney, Agent, or Firm* — Nolte Lackenbach Siegel

(57) ABSTRACT

A variable geometry anchor for controlling drift of a watercraft including: a support structure; a mast support assembly pivotally mounted to the support structure, the mast support assembly including a pair of mast arms and a foldable or flexible structure attached to the mast arms, the mast arms being movable between a first storage geometry and an operation geometry; an open-close sub-system pivotally connected to the support structure and operatively connected to the mast support assembly at fixed pivot mounts on the mast arms; wherein the open-close subsystem controls the geometry of the mast support assembly such that in a storage orientation the open-close subsystem closes the mast arms substantially together whereby the foldable or flexible structure is received between the mast arms, and in an in use condition the open-close subsystem operatively urges the mast arms apart unfolding and fanning the foldable or flexible structure there between.

20 Claims, 11 Drawing Sheets

(56) References Cited

U.S. PATENT DOCUMENTS

| | | | | |
|---|---|---|---|---|
| 10,526,050 | B1 * | 1/2020 | Turek | B63B 21/26 |
| 2011/0209652 | A1 * | 9/2011 | Bernloehr | B63B 21/26<br>114/230.13 |

* cited by examiner

LIGHTWEIGHT SEA ANCHOR SYSTEM

CROSS REFERENCE TO RELATED APPLICATIONS

The present application claims priority to and the benefit of co-pending AUSTRALIAN Provisional Patent Application Serial No. 20169037958 filed on Sep. 20, 2016, entitled "AN IMPROVED LIGHTWEIGHT SEA ANCHOR SYSTEM" and co-pending AU PCT Patent Application Serial No. PCT/AU2017/051025 filed on Sep. 20, 2017, entitled "PIVOTING SEA ANCHOR SYSTEM". These references are hereby incorporated in their entirety.

FIELD

The present embodiment generally relates to an improved sea anchor and system for controlling drift of a watercraft such as a boat using the improved anchor.

In particular the present invention relates to an improved variable geometry anchor for a watercraft which is effective for controlling drift when fishing to substantially improve boating experience and fishing outcome.

The invention has been developed primarily for use in/with an improved anchor for improving control of drift of a watercraft or vessel such as a boat, and will be described hereinafter with reference to this application. However, it will be appreciated that the invention is not limited to this particular field of use.

BACKGROUND

A need exists for an improved sea anchor and system for controlling drift of a watercraft such as a boat using the improved anchor.

The present embodiments meet these needs.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

Figure 1:
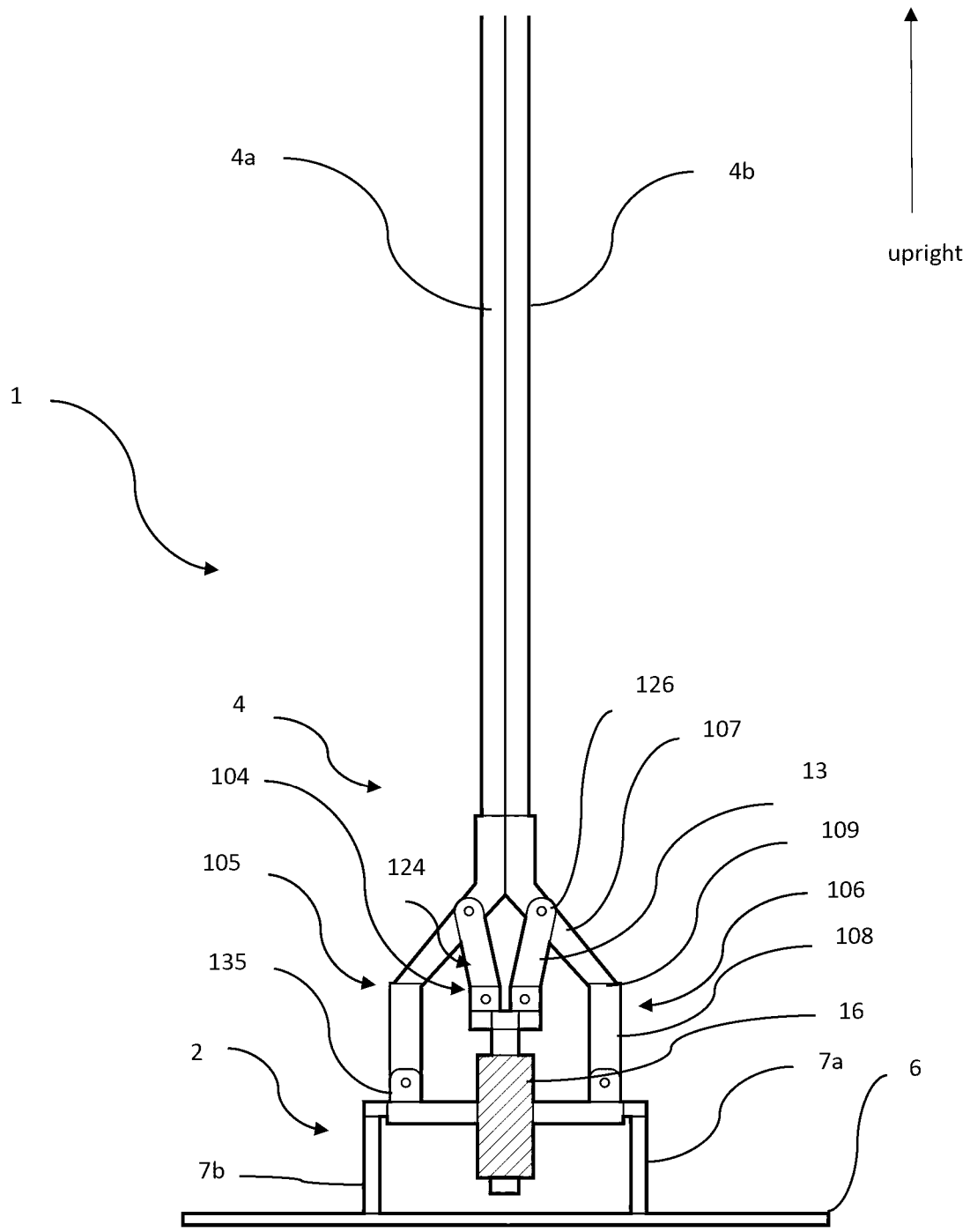
FIG. 1 is a schematic representation from one side of a variable geometry anchor in a storage condition in accordance with a preferred embodiment of the present invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

An anchor for a watercraft such as a ship or boat is a device, normally made of metal, is used to connect the watercraft to the bed of a body of water to prevent the watercraft or vessel from drifting due to wind or current, and to stabilize the craft in heavy weather. A conventional anchor can take on various forms but generally has the form of a mass tethered to the watercraft using a rope or chain. To anchor the watercraft, the mass is thrown or dropped overboard into the body of water whereupon it sinks to the bottom thereof and engages the seabed.

In the context of sports and recreational fishing, often performed in shallow water populated by a variety of fish, the use of a conventional anchor is often not desirable because the watercraft can drift erratically and widely with prevailing currents of the water. This drifting effect can place the boat in an unintended position other than a position most advantageous for shallow water fishing such as within a spread of live bait. As a result of uncontrolled drift, a fisherman may need to periodically haul the anchor to allow repositioning of the boat. Sport fishing generally requires control of drift, and in a fast moving current or moderate breeze for example, a conventional anchor offers little control of drift.

A further problem arises with a conventional anchor when a fisherman is trying to locate fish visually. Experienced fishermen can often locate and anchor their watercraft in areas where the amount of fish caught will be optimal by visual sighting of fish. When using a conventional anchor however, this technique is limited in circumstances where the mass of the anchor is dragged across the bottom surface of the body of water and stirs up particulate matter such that the fisherman's view of fish within the water is obscured. Concomitant damage of vegetation growing at the bottom of the body of water can also occur as the mass is dragged across it.

In addition to the foregoing problems, the action of throwing the anchor into the water often causes a loud noise and splash in contact with the water that in turn can scare away fish in proximity to the boat. When using a conventional anchor, a fisherman must make every attempt to control drift, minimize noise so as not to scare the fish, and minimize drag across the seabed to maintain visual sighting of fish.

Some attempts have been made in the prior art to address problems with conventional anchors. One attempt to control drift has been to use a parachute-type sea anchor or drogue which has a canopy and attached rigging which allows the canopy to open in water when the rigging is released. This type of anchor tends to be more suitable as a safety device to keep the bow of a craft into the seas when the craft becomes disabled. A particular drawback is that rigging may become twisted, and when rigging and chute are brought back on deck the system often needs to be manually untwisted before next deployment, and during the process of untwisting shroud lines, an operator may become wet.

Other types of anchors can include a drift control sock fabricated from lightweight material such as nylon or polypropylene. A control sock can include a funnel shaped chute to catch water and restrict flow through a small opening at its opposite end, and a trip line tethered to the craft to allow an operator to collapse the chute and pull the chute into the boat to tight a fish or move to another spot. The drift control sock also includes weights at the lower end to promote flotation of an upper portion and quick openings of the funnel while restricting rotation. This type of anchor is however prone to becoming entangled in a crafts propeller, spinning and collapsing, and when brought on board from deployment in the water, needs to be physically/manually unwound, excess water shaken off, while trying to minimize entanglement with the boat, for storage and/or redeployment often times when fishing, and time is of the essence, the time taken to collapse, pull in a retrieval line, shake-off excess water, disentangle and folded for further deployment, means that the probability of a catch is lost A further disadvantage is that if the anchor is not being used, it needs to be packed away otherwise if left on the floor of a boat, it can be caught in winds when travelling at speeds. An even further disadvantage of the control sock is that in use it restricts fishing to the front of the boat and the side opposite of the boat to which the sock is deployed, i.e., fishing cannot be conducted from the same side of the boat as the sock in a conventional way.

The use of drift control socks and sea anchors of the chute-type generally requires a reasonable level of seamanship and restricts the range of drift before a boat needs to be repositioned. A recent attempt to address these shortcomings has resulted in a shallow water anchor mounted to a rear end portion of a boat operable remotely to release a telescopic talon or extendable retractable spike vertically, that penetrates the sea bed. Such a device locks the boat into a particular spot. One drawback however is that such a device is limited to shallow waters. A further drawback is that the device tends to lock the craft and therefore restrict drift.

It can therefore be seen that the anchors of the prior art have a range of problems including one or more of:

a. Complex structure
b. Lack of drift control;
c. Twisting and entanglement of rigging;
d. Entanglement of rigging with propeller;
e. Hauling in rigging and removing water for redeployment and/or storage;
f. Time elapse for hauling in rigging and readiness for redeployment;
g. Restriction on fishing from front or opposite side of a boat In view of the above, it is desirable to have an anchor that addresses and ameliorates at least one or more of the prior art deficiencies or at least provides a practical variation to avert from one of more of the prior art deficiencies.

It is to be understood that, if any prior art information is referred to herein; such reference does not constitute an admission that the information forms part of the common general knowledge in the art, in Australia or any other country.

SUMMARY OF INVENTION

According to a first aspect of the present invention, there is provided a variable geometry anchor mountable on a watercraft such as a boat for controlling drift of the watercraft including: a support structure mountable to a deck portion of the watercraft; a mast support assembly adjustably mounted to the support structure; a mast assembly operatively interconnected to the mast support assembly comprising: a support frame adjustable substantially simultaneously by the mast support assembly in: a first plane between a storage orientation and an operational orientation, and a second plane between a storage geometry and a drift control geometry; a web sheet mounted by the support frame, the web sheet being movable by the support frame to provide effective drift control in the drift control geometry; at least a first actuator mounted on the support structure, and operably connected to the mast support assembly to selectively control the orientation of the support frame of the mast assembly; wherein in a drift control operating condition the at least first actuator acts on the mast support assembly to effect change in the orientation of the support frame in the first plane between the storage and operational orientation, and wherein the support frame changes geometry in the second plane so that the combined support frame and web sheet adopts a configuration effective to control drift of the watercraft.

The present invention represents an advance over prior art anchor systems because the orientation and geometry of the mast assembly is controllable by the mast support assembly so as to minimize deficiencies of prior art such as twisting of rigging and time taken to redeploy.

The support frame can comprise a pair of arms mounted to and movably adjustable by the mast support assembly. In a storage orientation, the pair of arms are adapted to abut to form a unitary structure oriented upwardly or vertically located out of the water.

In an operating or drift control condition, the pair of arms of the support frame are oriented downwards from the storage orientation into the water, and the arms are separated by the adjustable mast support assembly to unfold the web sheet. In one embodiment, the distance between the arms can be adjusted by the mast support assembly to widen and tension the web sheet to provide adjustable and controlled resistance to the water flow.

In the storage orientation, with the pair of mast arms abutting to form a unitary structure, the web sheet is substantially folded there between and water allowed to drain. There is therefore no requirement to untangle rigging as in the prior art, and the assembly can be immediately redeployed.

In the operating or drift control condition, with the pair of mast arms apart forming a trapezoidal geometry, the web sheet extending between the arms thus forming a webbing between the arms for creating resistance and controlling drift.

In one embodiment, the mast assembly can further include a storage sheath for receiving the pair of mast arms in a storage condition.

Preferably the deck portion is the transom.

In a related aspect of the invention there is disclosed a variable geometry anchor mountable on a watercraft such as a boat for controlling drift of the watercraft including: a support structure mountable to a portion of the watercraft; a mast support assembly adjustably mounted on the support structure; a mast assembly comprising: a support frame comprising a pair of mast arms mounted to and movably adjustable by the mast support assembly between a storage and operational configuration, and a web sheet mounted by the pair of mast arms of the support frame, the web sheet being movable between a storage condition and an operating condition by the arms; a first actuator mounted on the support structure, and operably connected to the mast support assembly to selectively control the mast support assembly, wherein in a drift control operating condition the at least first actuator acts on the mast support assembly to change the orientation and configuration of the support frame between a storage and in use position, and wherein the arms and interconnected web sheet of the mast assembly provide an effective operating configuration to control drift of the watercraft.

The present invention can be redeployed very quickly and efficiently compared to the prior art. Further, in a storage condition the orientation and geometry of the mast assembly allows water to drain easily, and therefore ready to redeploy quickly and substantially without a user required to physically haul the anchor into the boat and disposed to getting wet.

In one embodiment, the support structure can be mounted to a rear portion of the watercraft, preferably on the engine or outboard engine bracket. This allows access to all areas of the boat for fishing.

In one embodiment of the invention, the variable geometry anchor can include a second actuator operatively connected to the mast assembly to assist the first actuator raising and lowering the arms of the support frame and tensioning and widening of the web sheet.

In a further embodiment of the invention, the variable geometry anchor can include a further actuator operatively connected to the mast assembly wherein the further actuator can operate to change the angle of the web sheet relative to the mast support assembly in the water, to further assist fine drift control. This means that the angular positioning of the web sheet when extended by the pair of arms can be altered by the second actuator to control right and left drift of the boat in the water, or control rate of drift.

Preferably the further actuator can be used to pivot the anchor system to enable the stern (front) of the boat to be controlled left or right remotely.

If for example, currents in the water are running at angles to the watercraft, the web sheet can be adjusted in the water by the second actuator to cater for improved fine control. This represents a particular advantage in tournament fishing where greater control of directional drift and rate of drift can be achieved so as to improve a fishing result.

In one embodiment, a user can position the mast assembly of the variable geometry anchor to counter prevailing currents, and substantially maintain a desired rate and direction of drift depending on fishing requirements. This clearly represents an advantage over the prior art systems.

The web sheet can further include a plurality of magnets on an upper edge portion to aid folding of the web sheet when the arms are moved from an operating condition to a storage position.

The support structure can comprise a base plate attachable to a deck portion of the boat, and a pair of arm members fixed to the base plate at an angle. The support structure can comprise a specialized mount bracket attached between the jack plate and transom or between the outboard and transom, and a pair of arm members fixed to the base plate at an angle.

Preferably the variable geometry anchor further includes a sub-frame assembly mounted to the base plate adapted to receive a second actuator. The sub-frame assembly can include a sub-frame structure mounted on the base plate and generally extending upwardly, and a drive arm pivotally connected at one end to the sub-frame structure and pivotally connected to the second actuator.

The variable geometry anchor can further include a second drive arm pivotally connected to the second actuator at one end and pivotally connected to the mast support assembly.

The mast support assembly can comprise a series of interconnected pivot arms pivotally connected at one end to the first actuator and a pivot point on the fixed arm members mounted to the support assembly. The web sheet can be fabricated from a neoprene material of about 0.5 mm thickness. The web sheet can include internal panels which may include baffles or magnets to aid folding of the web sheet when the arms are moved from an operating condition to a storage position.

The pair of arm members can be poles fabricated from a range of materials including aluminum, carbon fibre or fiberglass. The web sheet can include a series of spaced apart panels interspersed with elastic membrane. The web sheet can also include a fin preferably of metal such as aluminum, to assist retaining the sheet in a folded condition during storage.

In a further related aspect of the invention there is disclosed a variable geometry anchor mountable on a watercraft such as a boat for controlling drift of the watercraft including: a support structure mountable to the transom portion of the watercraft; a mast support assembly adjustably mounted on the support structure; a mast assembly comprising: a support frame comprising a pair of arms mounted to and movably adjustable by the mast support assembly between a storage and operational configuration, and a web sheet mounted by the pair of arms of the support frame, the web sheet being movable between a storage condition and an operating condition by the arms; a first actuator mounted on the support structure, and operably connected to the mast support assembly to selectively control the mast support assembly; a second actuator operatively connected to the mast assembly adapted to adjust the angle of the web sheet relative to the mast support assembly in the water, to assist fine drift control; wherein in a drift control operating condition the at least first actuator acts on the mast support assembly to change the orientation of the support frame between a storage and in use position, and wherein the arms of the support frame of the mast assembly changes geometry are reconfigured by the arms so that the web sheet of the mast assembly adopts an operating configuration by the arms effective to control direction and rate of drifting of the watercraft.

Benefits of the system include one or more of:

The mast support assembly minimizes requirement for physical hauling in of an anchor and exposure to wet;

The fine control of the mast assembly allows greater control of direction and rate of drift of watercraft;

The orientation of the mast assembly by the mast support assembly allows easy draining of water in a storage condition;

Time taken to redeploy is significantly reduced compared to prior art;

The ability to adjust the angle of the mast assembly in an operating condition improves the degree of control of a user over rate of drift of a boat and direction of drift In a further related aspect of the invention there is described a variable geometry anchor for controlling drift of a watercraft including: a support structure; a mast support assembly pivotally mounted to the support structure, the mast support assembly including a pair of mast arms and a foldable or flexible structure attached to the mast arms, the mast arms being movable between a first storage geometry and an operation geometry; an open-close sub-system pivotally connected to the support structure and operatively connected to the mast support assembly at fixed pivot mounts on the mast arms; wherein the open-close subsystem controls the geometry of the mast support assembly such that in a storage orientation the open-close subsystem closes the mast arms substantially together whereby the foldable or flexible structure is received between the mast arms, and in an in use condition the open-close subsystem operatively urges the mast arms apart unfolding and fanning the foldable or flexible structure there between.

The variable geometry anchor can further include a flip-flop sub-system, which is mounted to the support structure and operatively connected to the mast support assembly, the flip flop subsystem being adapted to alter the orientation of the mast support assembly in a separate or combined action to the open close subsystem, from a substantially upright or stored position to a position below the level of the deck of the watercraft.

The open close subsystem can comprise a linear actuator and a pivoting arm assembly said arms having one end thereof connected to upper leg portions of the mast support assembly by a pivot mount, and opposite ends of the arms pivotally connected to linear actuator.

The flip flop subsystem can include a linear actuator with piston, the actuator being fixedly mounted at one end to a base support or deck, and a swing arm pivotally attached at one end to the piston and the other end to a pivot mount on a fixed support, the swing arm being further operatively connected to the mast support assembly, wherein the actuator of the flip flop subsystem flips the swing arm in an arcuate pathway and changes the orientation of the mast support assembly.

Other aspects of the invention are also disclosed with reference to accompanying drawings and examples.

DESCRIPTION OF PREFERRED EMBODIMENTS

It should be noted in the following description that like or the same reference numerals in different embodiments denote the same or similar features.

Referring to the drawings there is shown an improved variable geometry anchor 1 adapted to (a) change orientation between a substantially upright storage position and a drift control position extending below the level of a boat deck, and (b) change geometry to affect control of rate of drift of a watercraft such as a boat or the like vessel (not shown). A clear benefit of the variable geometry anchor is the ability to provide in control of a watercraft position which is most advantageous for shallow water recreational fishing.

In the figures, and particularly FIG. 1, the variable geometry anchor 1 broadly comprises a support structure 2 which can a deck of a watercraft such as a boat or a structure to be mounted on a deck of a watercraft, a mast support assembly 4 pivotally mounted to the support structure, and an open close subsystem 104 operatively connected to the mast support assembly 4. The open close subsystem 104 operates the mast support assembly to alter the positioning of mast arms 4*a* and 4*b* and intermediate attached web sheet material or panel system to provide a fanning effect, and in turn the overall geometry of the anchor.

The variable geometry anchor 1 in a further embodiment (FIGS. 3 and 4) comprises, in addition to the open close subsystem, a flip flop subsystem 125, which is mounted to the support structure and operatively connected to the mast support assembly. The flip flop subsystem is adapted to alter the orientation of the mast support assembly in a separate or combined action to the open close subsystem, from a substantially upright or stored position to a position below the level of the deck of the watercraft.

As shown, the support structure 2 of the anchor 1 is adapted for mounting on the transom of a watercraft such as a boat (not shown). However it is equally feasible for the mast support assembly to be mounted directly to the deck of a boat.

The support structure 2 includes at least a base plate 6 for attachment to the transom of a boat, and a pair of spaced oppositely disposed fixed angled arm members ?a (best seen in FIG. 3) and 7*b* mounted to the base plate.

Figure 2:
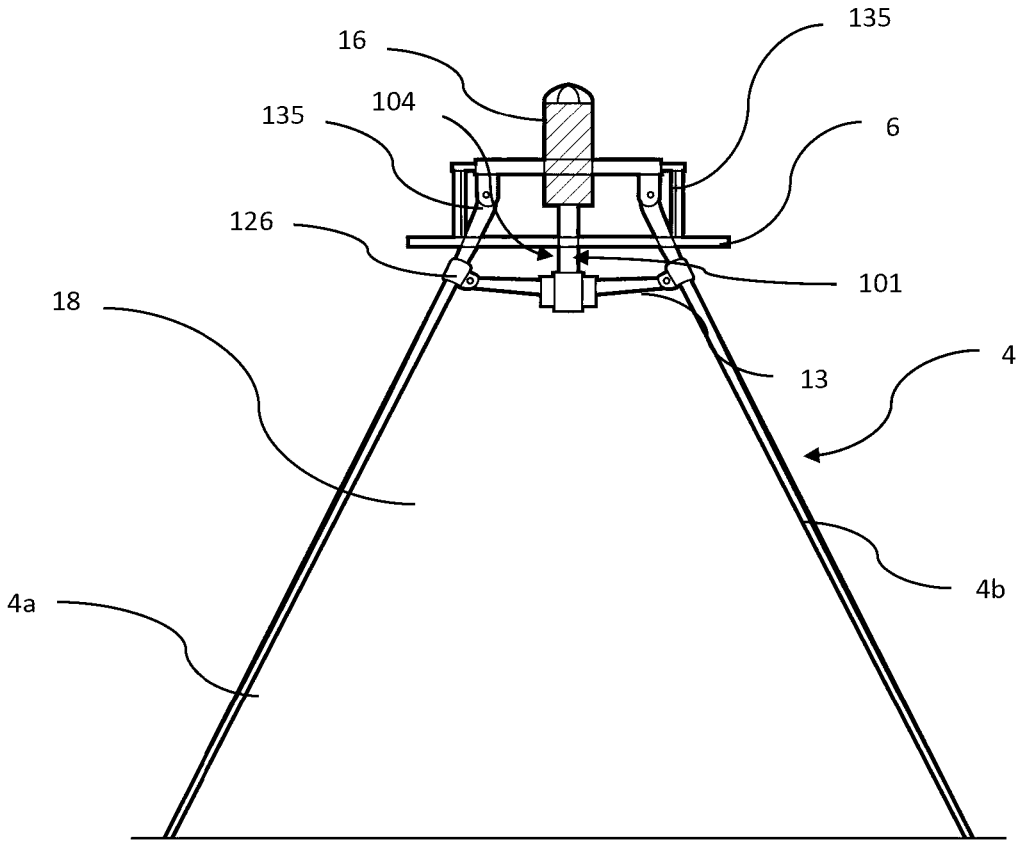
FIG. 2 is a schematic representation of the variable geometry anchor in FIG. 1 from one side view shown in an operating condition.

In one embodiment shown in FIG. 1, the mast support assembly 4 of the anchor 1 is mounted to the base plate 6 of the support structure 2, and the open close subsystem 104 is operatively connected to the mast support assembly 4, wherein the mast support assembly is adapted to change geometry by the open close subsystem. In FIG. 2, in addition to the change in geometry as shown by fanned configuration of mast arms and attached web sheet or hinged panels, the orientation of the mast support assembly in FIG. 1 has also changed between a stored upright condition (best shown in FIG. 1) and a drift controlling condition (see FIGS. 2 and 8) for controlling drift operation of a watercraft by the flip flop subsystem 125 (see FIGS. 2 and 8).

In general, it can be shown that there is a combination of at least two features that form the synergistic improved variable geometry anchor, which can be selectively identified as an open close subsystem 104 and a flip flop subsystem 125.

As shown there is an open close subsystem in order to adjust the mast assembly from a closed storage position (FIG. 1) to a fanned-out drift control position by the variation in geometry of the mast assembly between a storage condition and a drift control condition.

There is also a flip flop subsystem which can bring about a change in orientation of the mast support assembly around a substantially horizontal axis such as by a flip flop mechanism from an out of water non-active position to an in water active position and vise-versa.

There can be devised with the invention a range of combinations including:

(i) Flip flop subsystem with open close subsystem that are both operated by a single inter-related drive actuator;

(ii) Flip flop subsystem with open close subsystem that are both operated by double inter-related drive actuators;

(ii) Flip flop subsystem with open close subsystem that includes a further drive actuator for rotational motion around a substantially vertical axis.

These can be combined with one or other of:

a) A frame b) A subframe on a frame c) A storage enclosure with a) or b)

A range of embodiments will be described to show some of these variations. Others will thereby be understood by persons skilled in the art.

First Embodiment—First Open Close Subsystem

In the figures, and particularly with reference to FIGS. 1 and 2, the variable geometry anchor 1 comprises a support structure 2 which can be mounted on a deck of a watercraft, a mast support assembly 4 pivotally mounted to the support structure, and an open close subsystem 104 operatively connected to the mast support assembly.

As shown in FIGS. 1 and 2, the mast assembly 4 comprises a pair of mast arms 4*a* and 4*b*, shown in a substantially contiguous (storage) condition in an upright orientation (FIG. 1), and legs 105 and 106 coextending from the mast arms. The legs include an upper portion 107 joined to a lower portion 108 by a pivot joint 109, the lower portion 108 of the legs 105 having one end connected to the support structure 2 by a pivot mount 135.

The open close subsystem 104 comprises a linear actuator 16 and a pivoting arm assembly 124 shown in the form of cam arms 13 (see FIG. 1) having one end thereof connected to the upper leg portions 107 of the mast support assembly by pivot mount 126, and opposite ends of the cam arms pivotally connected to the piston of linear actuator 16.

In this embodiment a web sheet 18 of flexible material (FIG. 2) such as neoprene or other suitable material is attached to the pair of mast arms 4*a* and 4*b* of the mast assembly.

As shown in FIG. 1 the linear actuator 16 includes a piston 101 connecting to one end of the cam arms 13 of the open close subsystem 104. In operation, as the piston extends from a retracted position as shown in FIG. 1 the piston displaces the cam arms of the open close subsystem 104 relative to pivot joint 126, which in turn drives lateral pivotal displacement of the upper portion 107 of the legs 105 and 106 about pivot joint 109 and pivoting movement of the lower portions 108 of the legs about pivot mount 135.

The synergy shown between the open close subsystem 104 and mast support assembly 4, drive a change in geometry of the mast support assembly 4. The change in geometry of the mast support assembly is illustrated between FIGS. 1 and 2 where a portion of the mast assembly described by arms 4*a* and 4*b* lie adjacent each other showing a substantially monolithic configuration (FIG. 1), and in FIG. 2 the same arms 4*a* and 4*b* are fanned open so that the mast arms and web sheet 18 define a trapezoidal geometry.

In one example, the pair of mast arms 4*a* and 4*b* are fabricated from aluminum, carbon fibre or fiberglass. The web sheet can also include internal panels which may include baffles or magnets to aid folding of the web sheet when the mast arms are moved from an operating or fanned condition to a storage folded position. The neoprene material can be of about 0.5 mm thickness.

In the embodiment shown in FIG. 1, the mast support assembly of the anchor 1 is shown in an upright storage condition in which mast arms 4*a* and 4*b* of the mast support assembly are adjacent forming a unitary structure oriented in a substantially upright or vertical orientation out of the water (not shown). The mast arms 4*a* and 4*b* are brought substantially together and held in a substantially abutting relation by the open close subsystem 104, and in this storage (upright) orientation of the mast support assembly the web sheet is folded or received between the mast arms in a first geometry so that water can be easily removed or drained.

As best shown in FIGS. 1 and 2, the first open close subsystem 104 comprises sub-assembly elements in the form of cam arms 13 pivotally connected at one end thereof to the mast arms 4*a* and 4*b* of the mast support assembly, and opposite ends connected to piston 101.

As shown in FIGS. 1 and 2, when cam arms 13 are acted upon by the piston of actuator 16, mast arms 4*a* and 4*b* of the mast assembly 4 are moved away from storage relation and open to form a fanned or trapezoidal shaped configuration expanding the web sheet from a folded condition.

Second Embodiment—First Open Close Subsystem and First Flip Flop Subsystem

Figure 3:
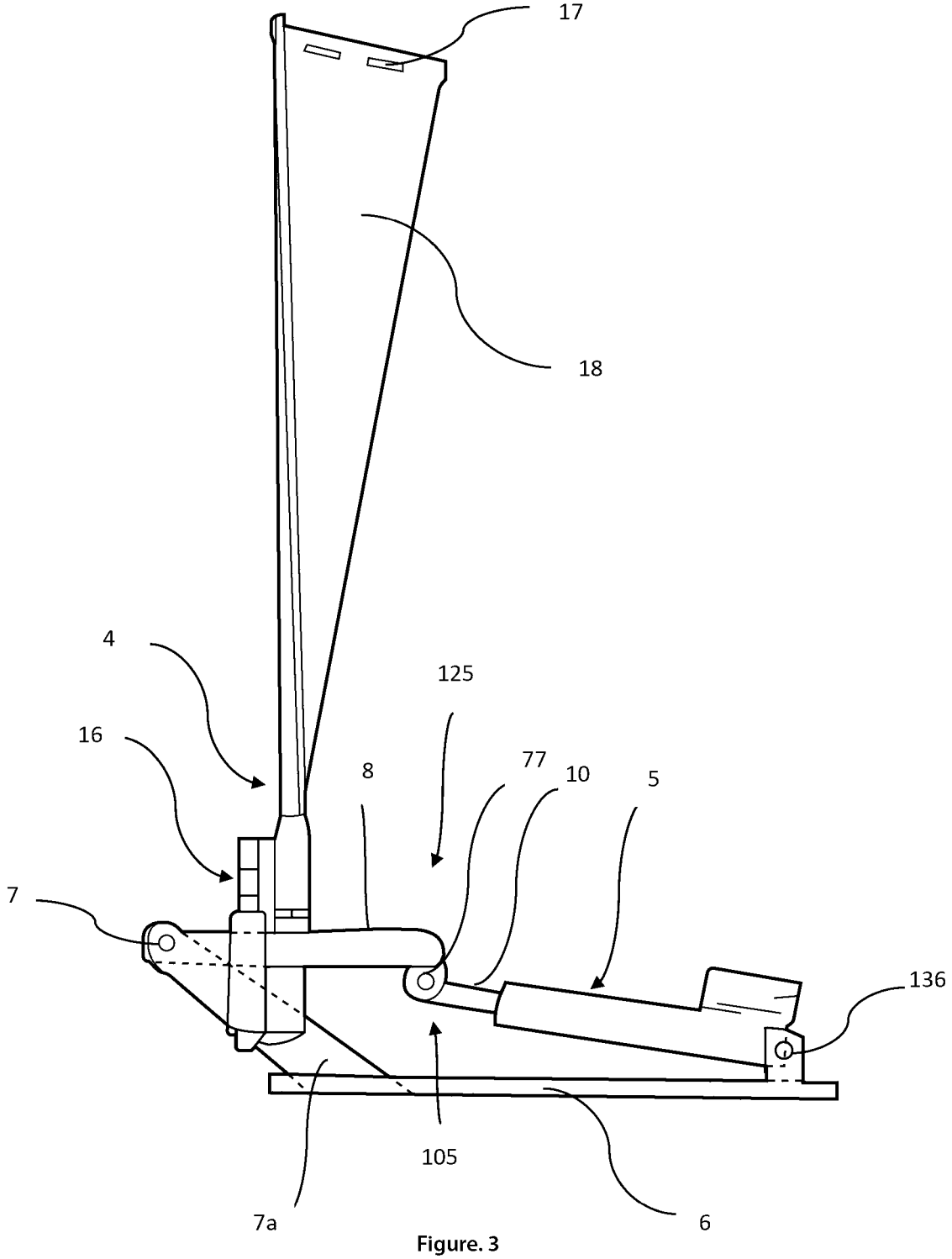
FIG. 3 is a schematic representation of an alternative side view of the variable geometry anchor in FIG. 1 in a storage condition.
Figure 4:
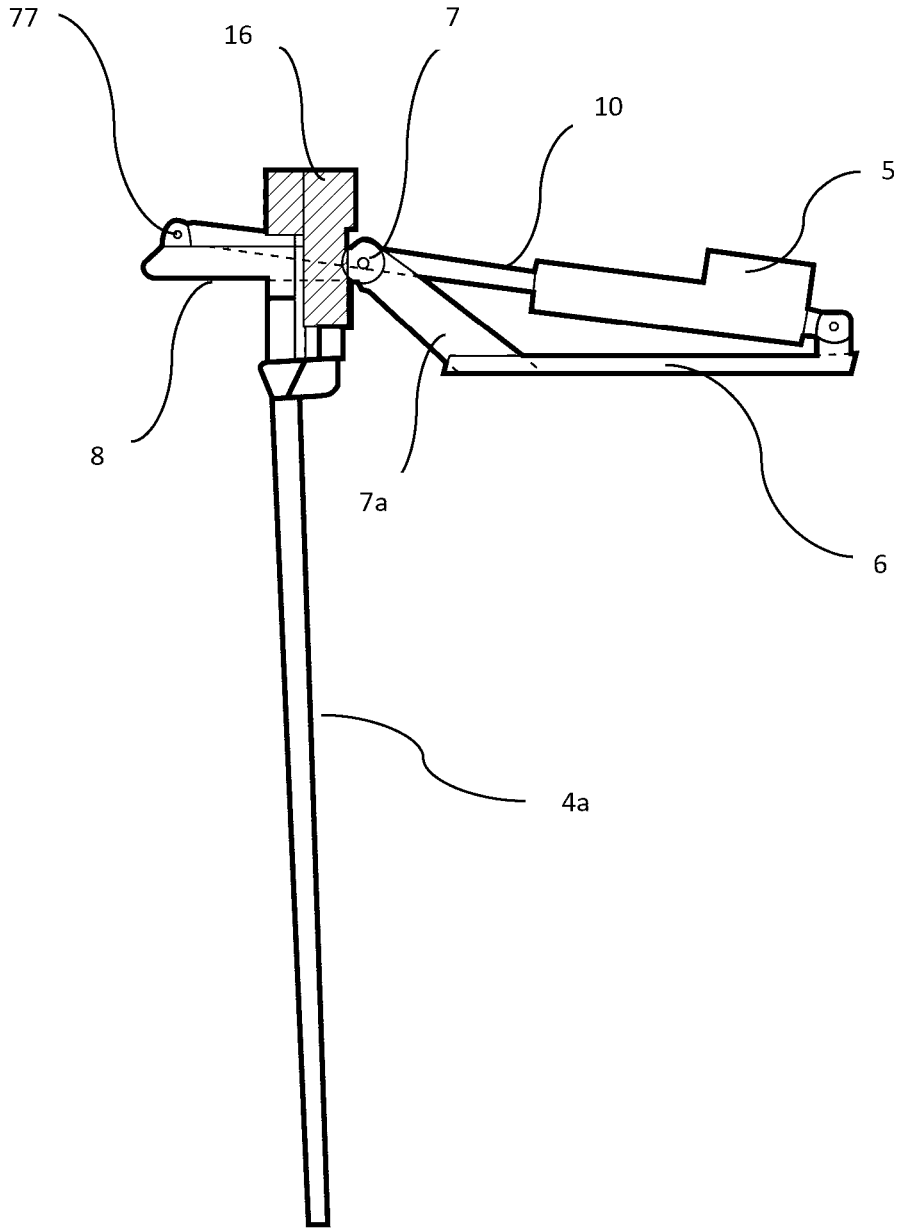
FIG. 4 is a schematic representation of an alternative side view of the variable geometry anchor in FIG. 2 in an operating condition.
Figure 5:
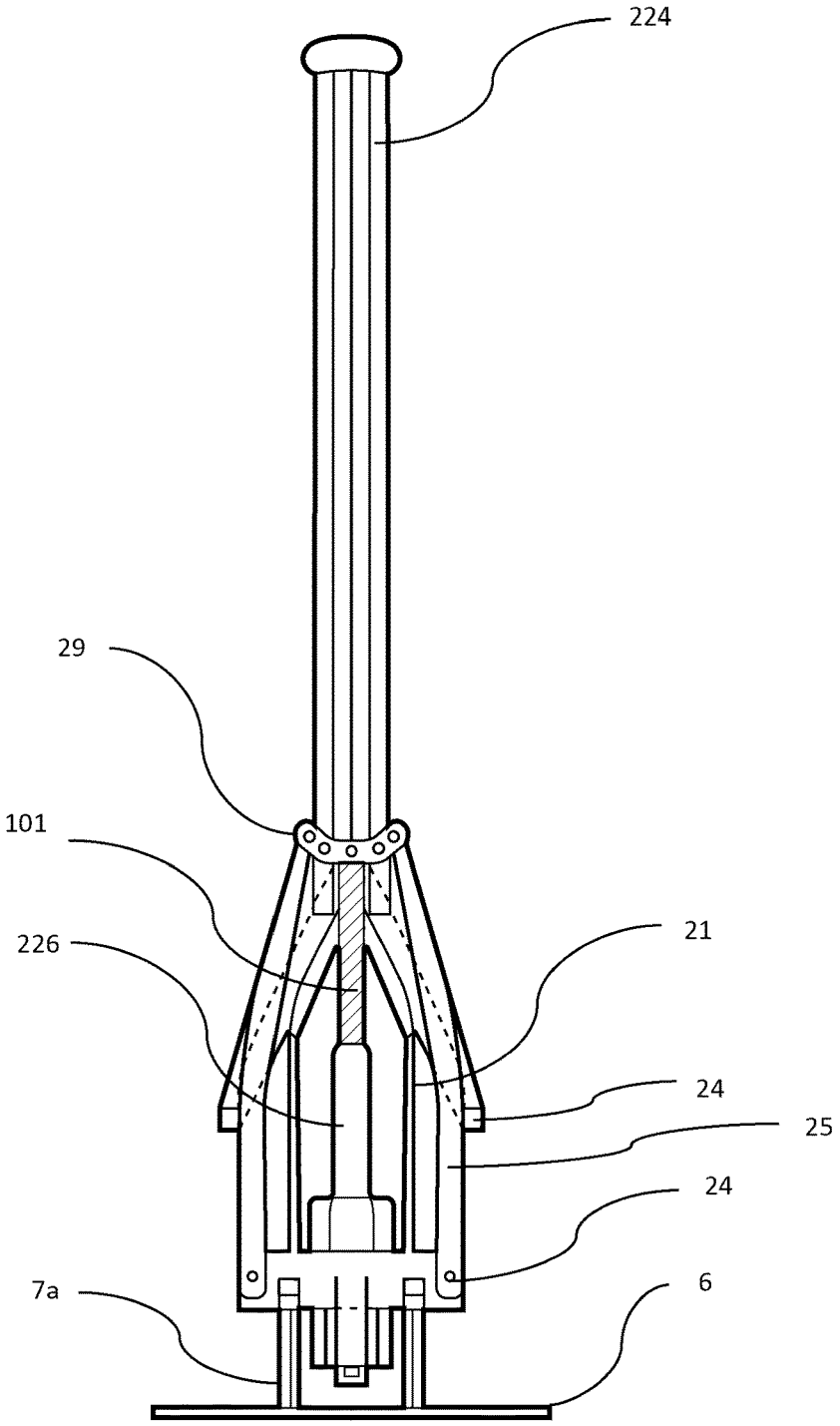
FIG. 5 is a schematic representation of the variable geometry anchor in a storage condition in accordance with a further preferred embodiment of the present invention.

Referring to FIGS. 3 and 4 there is shown an anchor 1 in accordance with a further embodiment of the invention having a first open close subsystem 104 and a first flip flop subsystem 125.

The first open close subsystem 104, adapted to change the geometry of the mast support assembly, includes an actuator 16 with a piston 101, and a pivoting arm assembly comprising pivotal sub-assembly cam arm elements 13 each connected pivotally at one end to the actuator piston and opposite ends pivotally connected to upper portions 107 of legs 105 and 106 of the mast support assembly 4.

In this embodiment actuator 16 of the first open close subsystem operates to allow change in geometry of the web sheet 18 by controlling the distance between the mast arms in the water (not shown). In a further embodiment, the angle of the web sheet can be altered to assist fine drift control in the presence of currents, tides and eddies in the water. Adjusting the angle of the web sheet relative to the water can substantially maintain a static drift where a boat can be retained in a desired position depending on the prevailing conditions and fishing requirements.

The first flip flop subsystem 125 includes linear actuator 5 shown mounted at one end 136 of the deck of the watercraft or base 6 of the support structure. The piston 10 of linear actuator 5 provides a pivot mount 77 at its end to pivotally connect a first end of a swing arm member 8. The opposite end of the swing arm member 8, distal to the piston, is pivotally connected to one end of fixed angled arm member 7*a* (best seen in FIG. 3) at pivot mount 9. The flip flop subsystem 125 further includes pivotal sub-assembly elements interconnecting the mast assembly 4 and swing arm member 8 so that when the swing arm is displaced by the piston 5 the mast assembly and therefore mast arms 4*a* and 4*b* can be reoriented up or down.

As shown in FIGS. 3 and 4, when the piston 10 of linear actuator 5 extends linearly, the swing arm member 8 is displaced over an arcuate pathway and therefore flipped about pivot mount 7 with extension of the piston 10 of linear actuator 5. Consequently, as the swing arm 8 flips over about pivot mount 7, the arcuate displacement of the arm 8 substantially simultaneously urges change in the orientation of the mast support assembly and therefore mast arms 4*a* and 4*b* are caused to reorient by pivotal movement about pivot mounts 135. Thus there is shown in FIGS. 3 and 4 an orientation transition from a storage (upright) position to a position in use below the level of the deck or support assembly upon actuation of the actuator 5 to extend piston 10. Similarly, in reverse, when the piston 10 of actuator 5 is retracted the swing arm 8 traverses the same arcuate pathway to bring the mast support assembly and mast arms from an in-use position back to a storage position.

The anchor 1 comprises a first linear actuator 5 fixedly mounted to the base plate 6 of the support structure 2 at fixed mount 136. The base 6 includes fixed angled arms 7*a* and 7*b* having a pivot mount 7 at one end in which one end of lower portion 108 of the legs 105 and 106 of the mast support assembly is pivotally received. As further shown in FIGS. 3 and 4, one end of fixed arm 7*a* provides a pivot mount point 7, and the swing arm member 8 extends about an arc over pivot mounts 77 and 7.

FIGS. 3 and 4 illustrate the combined changes in both orientation and geometry of the mast assembly 4. As shown in FIG. 3, the mast arms 4*a* and 4*b* are abutting and form a substantially upright oriented structure in a closed or storage geometry. In this condition, piston 10 of the linear actuator 5 is retracted. As shown in FIG. 4, as the piston 10 of the linear actuator 5 extends linearly, swing arm member 8 is accurately displaced about pivot mounts 77 and 7 causing rotational displacement of the arm member 8 and reorientation of the mast arms between a storage position in FIG. 3 and drift control position in FIG. 4.

The adjustment of the mast support assembly occurring between the configurations in FIG. 3 and FIG. 4 therefore changes (i) orientation of the mast assembly from a storage orientation in a substantially upright position to an operating position in water (not shown) adjacent the boat (not shown), and (ii) geometry of the mast support assembly because as the mast arms are urged apart by the open close subsystem, the flexible web sheet is unfolded to provide a resistance and therefore drift control mechanism in the water.

In a further embodiment of the present invention shown in the drawings, the anchor 1 includes a first open close subsystem 104 pivotally connecting to the mast support assembly 4 to change geometry of the mast arms, and a first flip flop subsystem operatively interconnected between a fixed support mount 136 and a pivot mount 7 on fixed angled arm 7*a* and wherein a part of the flip flop subsystem interacts with the mast support assembly for changing the orientation of the mast support assembly between an upright or storage position and an in-use orientation when the flip flop subsystem is actuated.

The first open close subsystem includes an actuator 16 operating a piston and cam arms 13 pivotally attached at one to the piston and the other end to upper portions of the legs 105 and 1 06. The flip flop subsystem also includes a linear actuator 5 with piston, the actuator being fixedly mounted at one end to a base support or deck, and a swing arm pivotally attached at one end to the piston 77 and the other end to a pivot mount 7 on a fixed angled arm 7*a*. The swing arm 8 is further operatively connected to the mast support assembly 4. In this embodiment the actuator 16 of the open close subsystem 104 operates to allow adjustment of the angle of the web sheet defined by the mast arms in the water (not shown) to assist fine drift control in the presence of currents, tides and eddies in the water. Adjusting the angle of the web sheet can substantially maintain a static drift where a boat can be retained in a desired position depending on the prevailing conditions and fishing requirements.

In a drift control operating condition the combined action of the open close subsystem and flip flop subsystem controls the orientation of the mast arms, i.e., the angle below the level of the deck, and the geometry of the web sheet, i.e., the extent of opening and angle of the web sheet in the water.

The ability to control the orientation of the mast arms of the mast support assembly in use, and adjust the geometry and relative angle of the web sheet in the water, allows a boat operator to control drift of the watercraft and therefore improve recreational fishing.

Third Embodiment Second Open Close Subsystem—Flexible

Referring to FIGS. 5 to 8, the variable geometry anchor as shown includes a support structure 2, a mast support assembly 4, an open close subsystem 104 operatively connected to leg portions of the mast support assembly to drive a change in geometry of mast arms 4*a* and 4*b*, and a flip flop subsystem 1 25 operatively connected to the mast arms of the mast support assembly to drive change in orientation of the mast support assembly between an upright storage position and an operating position angled below the level of the boat so that mast arms are located in the water.

The mast support assembly comprises upper mast arms 4*a* and 4*b*, and coextending angled lower leg portions 105 having one end thereof pivotally attached to a support 2 at pivot mounts 24. In this embodiment, there is shown a series of longitudinal shaped panels structures 31 interconnected by hinges, the terminal panels being attached to respective mast arms 4*a* and 4*b*. The series of panels 31 are adapted to fold against each other in a storage condition, and the terminal panels can also include a shaped edge for receiving the panels there within in a folded condition.

Figure 6:
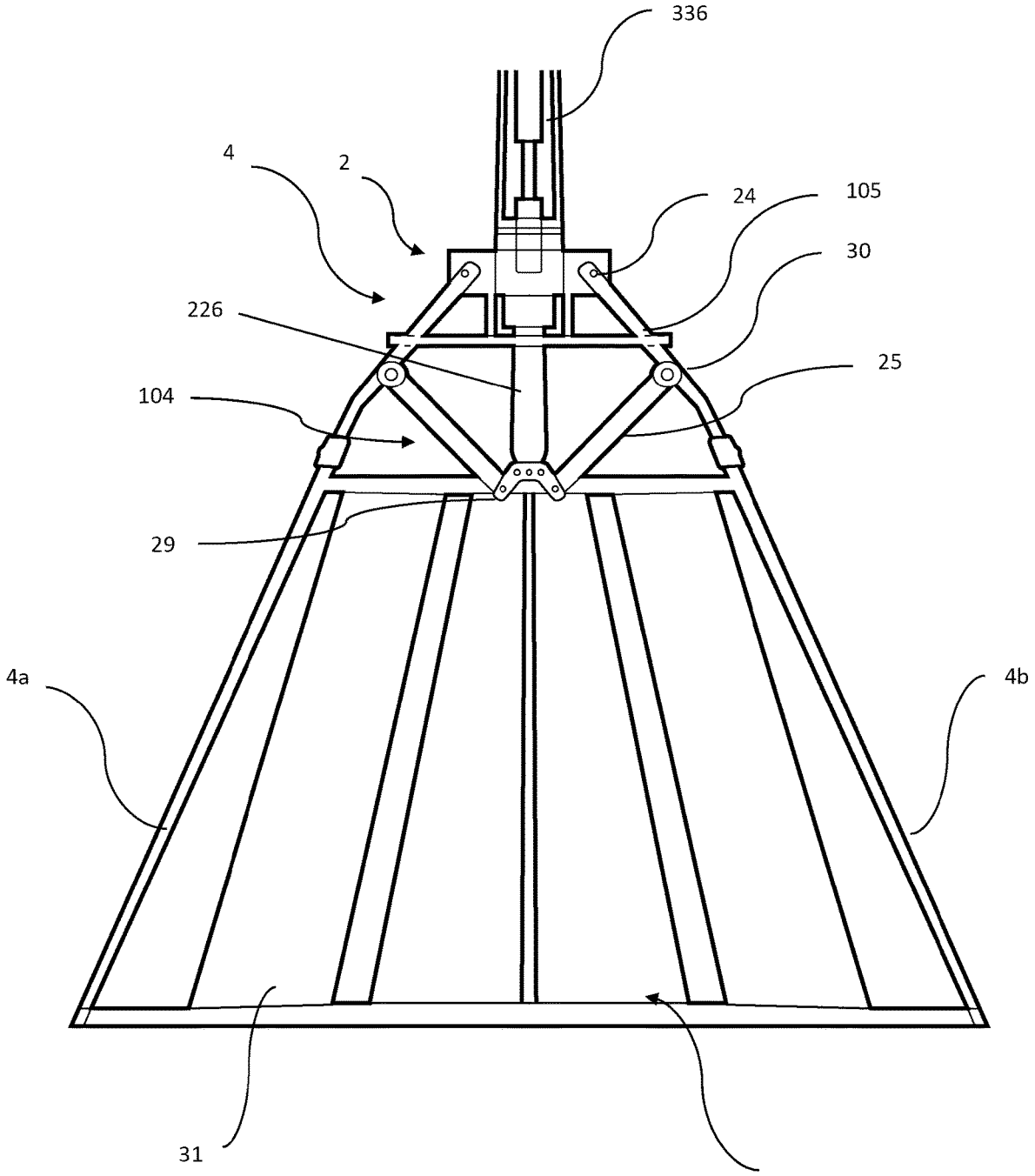
FIG. 6 is a schematic representation of a front side view of the variable geometry anchor in FIG. 5 in an operating condition.

The open close subsystem 104 comprises actuator 26 and a piston 101, and drive arms 25 being connected at one end to pivot mount 29 interconnecting the piston 101 and the opposite end pivotally attached to pivot mount 30 on the angled lower leg portions 105. As shown in an operating transition between FIGS. 5 and 6, the panels 31 attached between mast arms 4*a* and 4*b* are folded in a concertina arrangement in an upright orientation. In this orientation (FIG. 5), the piston 101 of actuator 226 is fully extended. In FIG. 6 the piston 101 is fully retracted. As the piston 101 is retracted by the actuator 226, drive arms 25 are displaced laterally about pivot mounts 29 and 30 causing legs 105 and mast arms 4*a* and 4*b* to unfold fanning the panels 31. The extent of fanning can be controlled, and the angle of the fanning structure formed by the mast arms and interconnected hinged panels can also be finely adjusted.

The flip flop subsystem 125 (best seen in FIGS. 7 and 8), which drives change in orientation of the mast arms, includes an actuator 336 pivotally mounted at one end to a sub-assembly 200, and a drive arm assembly 225 comprising a first dog-leg element 227 having one end pivotally attached to a pivot mount on a fixed support 221 of a sub-assembly 200 and a second end pivotally mounted to piston 301 at pivot mount 338, and a second dog leg element 228 having one end attached to pivot mount 338 and its opposite end mounted to pivot mount 277.

The anchor in FIGS. 5 to 8 includes a sub-assembly structure 200 having a lower support 221 fixed to the base plate 6 of a support assembly 2, and a sheath structure 224 fixed to an upper end of the lower fixed support 221 at joint 23, the sheath 224 receiving mast arms 4*a* and 4*b* of the mast support assembly therein in a storage condition.

The open close subsystem 104 further comprises a linear actuator 226 (best seen in FIG. 8) pivotally mounted to the base plate 6 of the support structure 2 at pivot mount 7.

Figure 7:
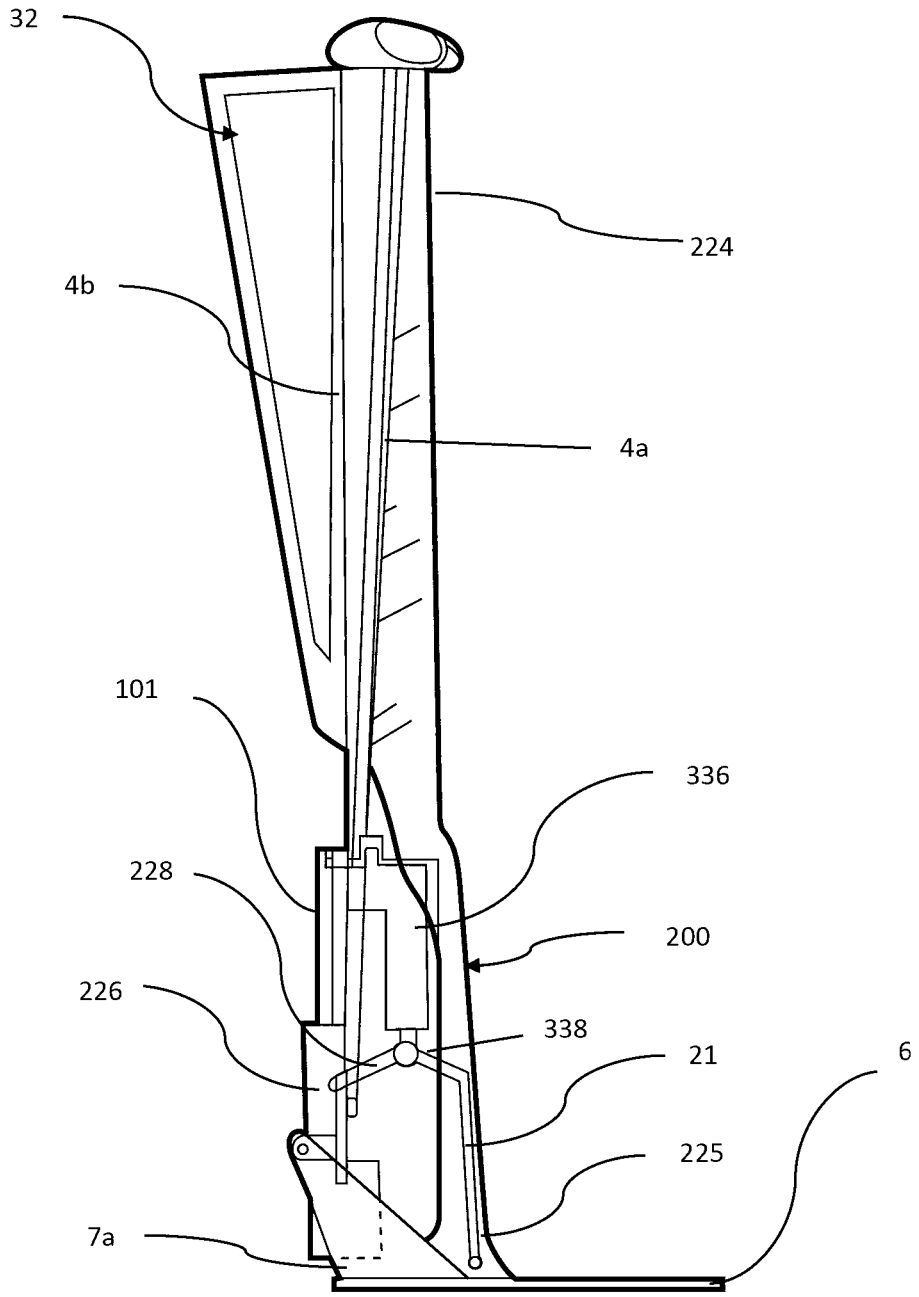
FIG. 7 is a schematic representation of an alternative side view of the variable geometry anchor in a storage condition in accordance with a preferred embodiment of the present invention.
Figure 8:
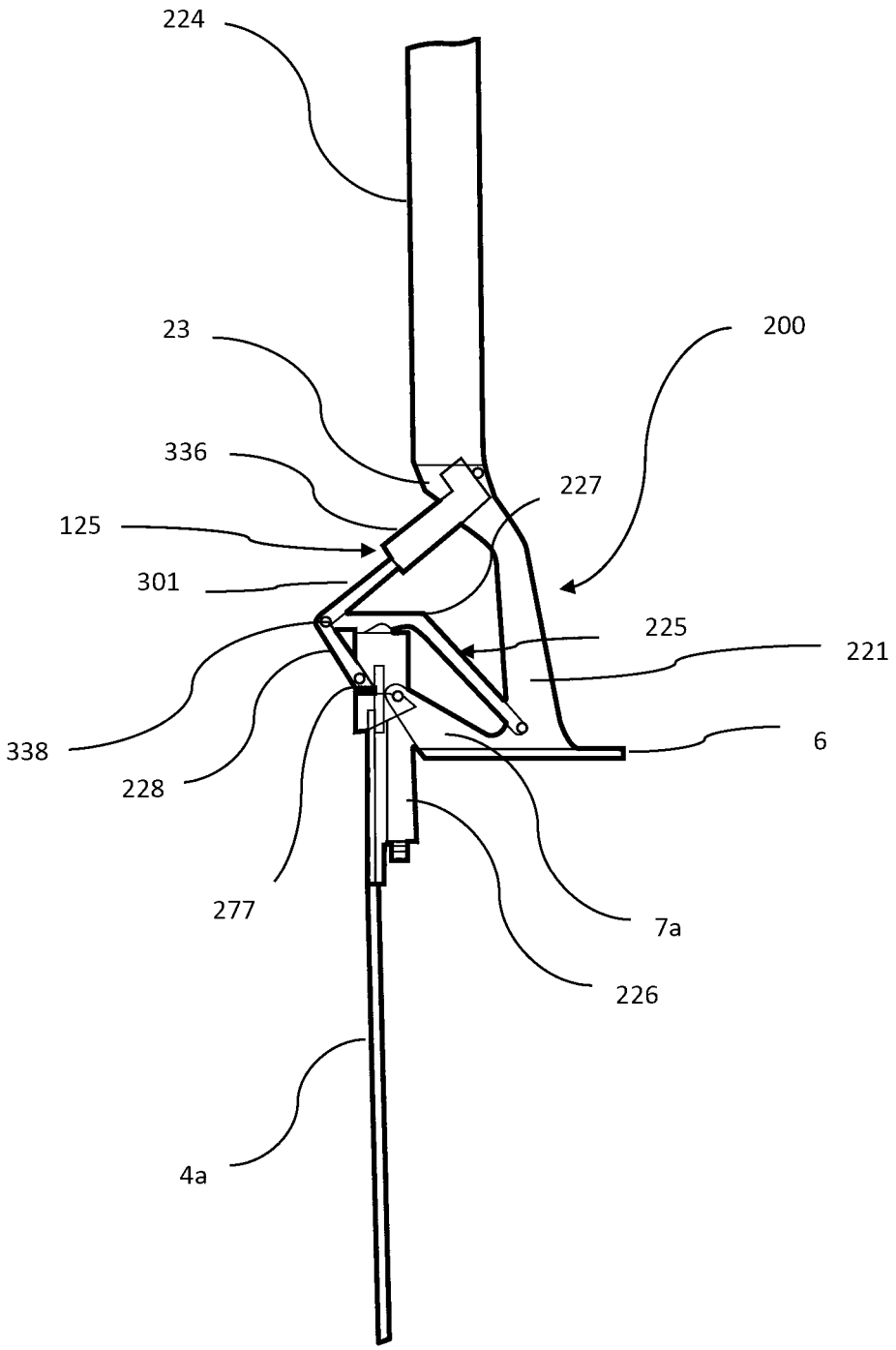
FIG. 8 is a schematic representation of a side view of the variable geometry anchor in FIG. 7 in an operating condition.
Figure 9:
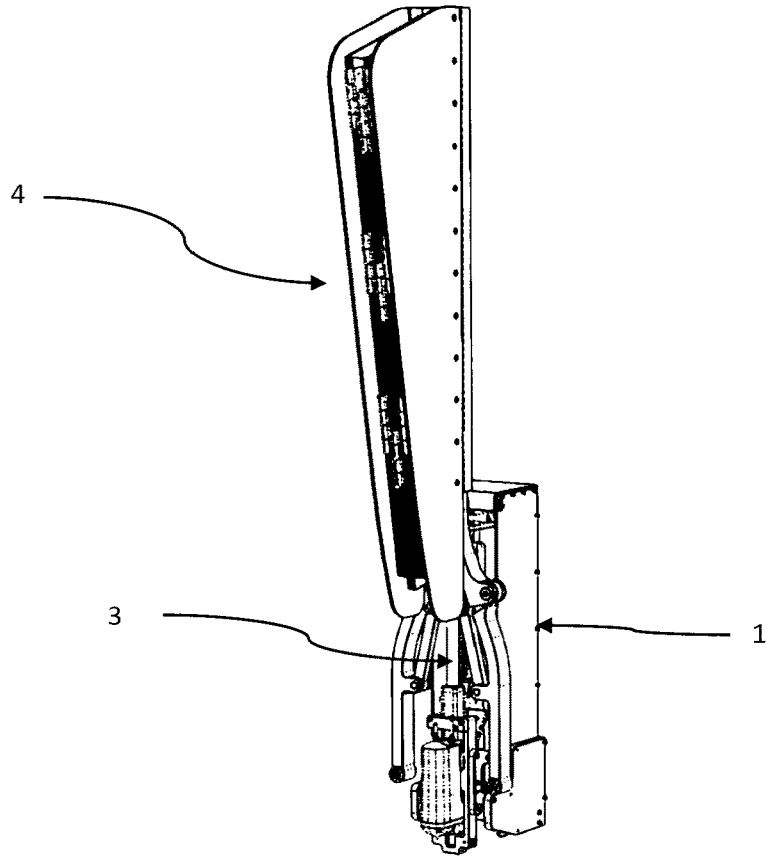
FIG. 9 is a photographic representation of a further embodiment of the present invention.
Figure 10:
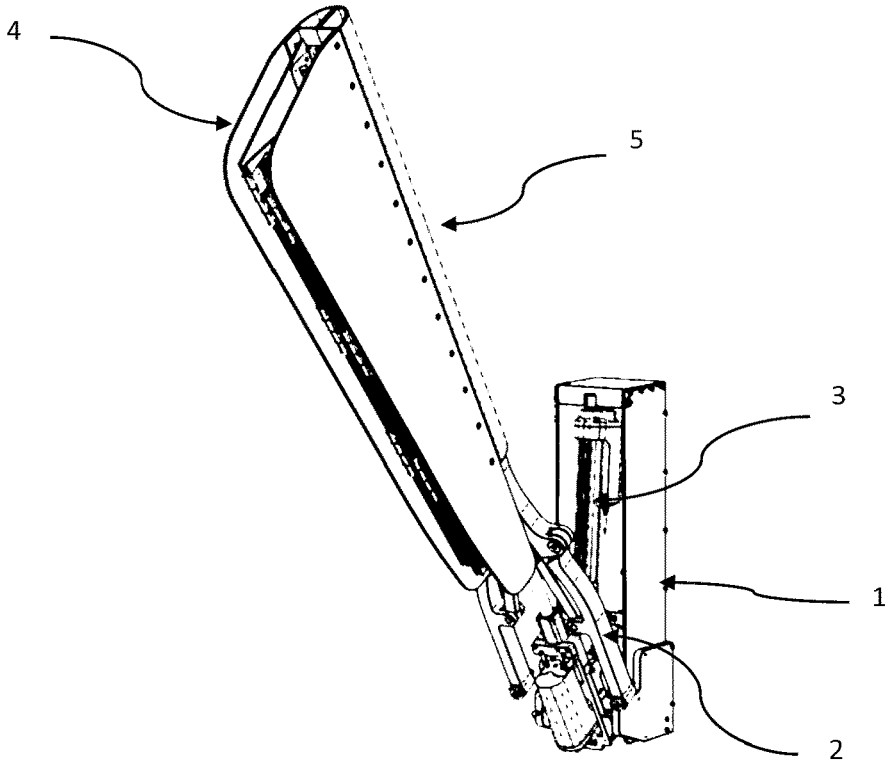
FIG. 10 is a photographic representation of an alternative view of the embodiment in FIG. 9.
Figure 11:
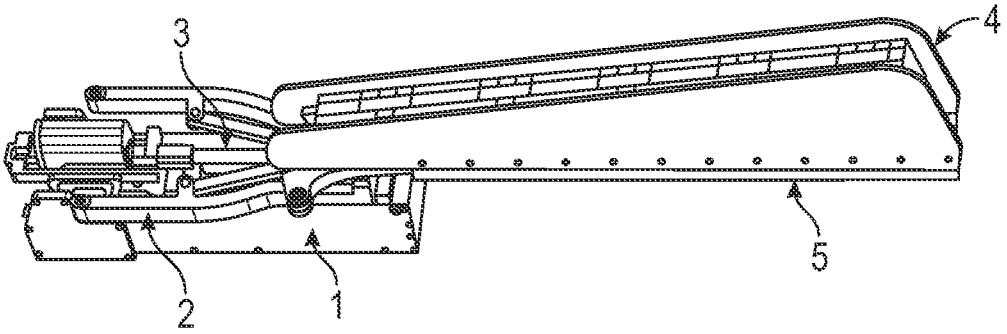
FIG. 11 is a photographic representation of an alternative view of the embodiment in FIG. 9.
Figure 12:
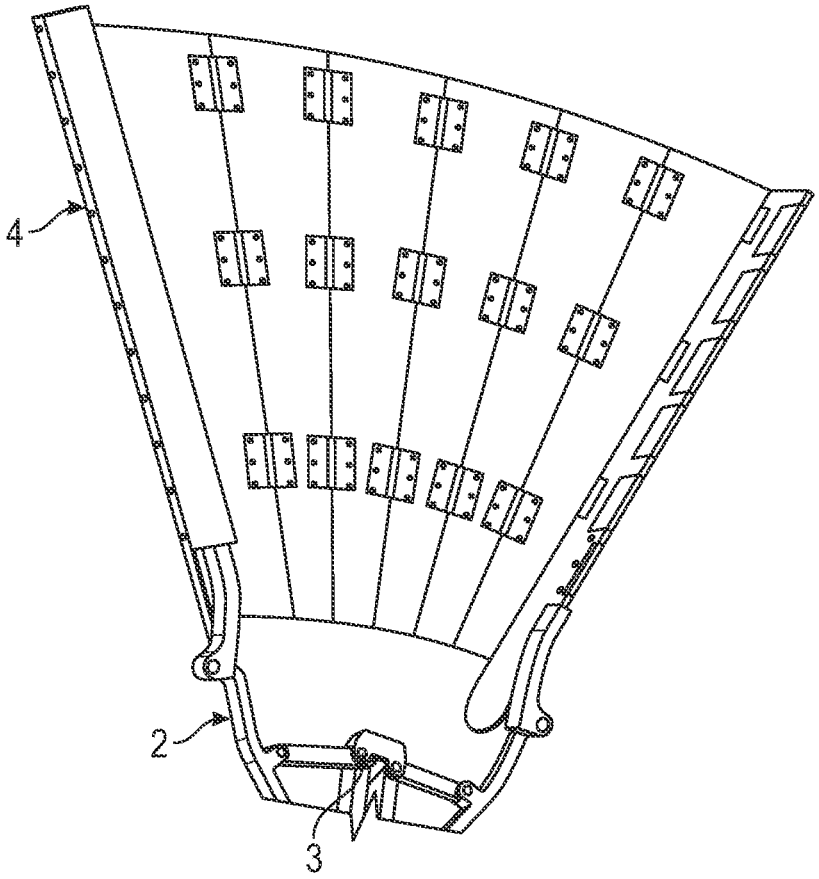
FIG. 12 is a photographic representation of an alternative view of the embodiment in FIG. 9.
Figure 13:
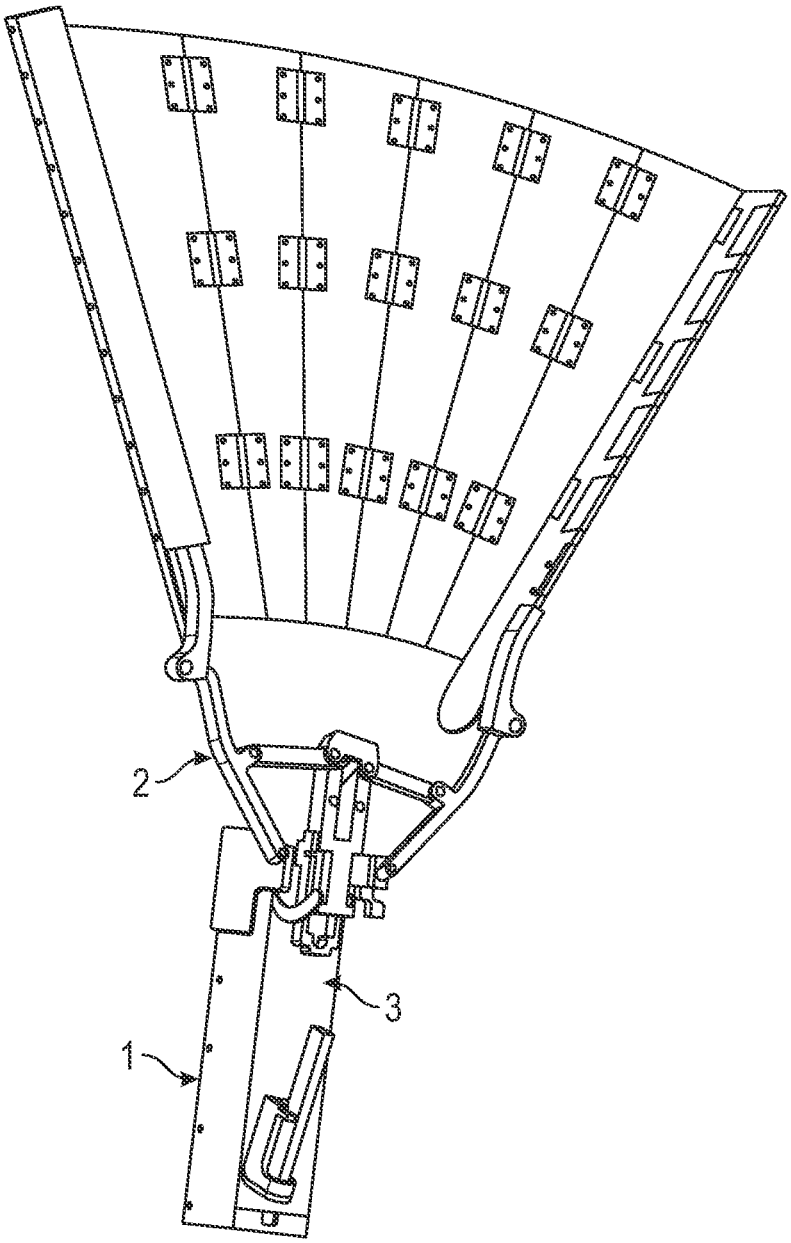
FIG. 13 is a photographic representation of an alternative view of the embodiment in FIG. 9.

As further shown in FIGS. 7 and 8, the actuator 226 displaces arms 4*a* and 4*b* from within sheath 224 from a storage condition to an operating condition. Arms 4*a* and 4*b* are controllably opened by the actuator 226 retracting piston 101 thereby urging drive arms 25 to open mast arms about pivot mounts 29 and 30.

As shown in FIGS. 6 and 7, the web sheet or series of panel members 18 of the mast assembly comprises a series of internal spaced apart panels 31 and a fin 32 attached to an edge portion of the web sheet to assist retain the web when in a storage position.

Fourth Embodiment—Second Open Close System—Semi Rigid

FIGS. 9 to 13 show a further variable geometry anchor system 10 in accordance with one embodiment of the present invention. The anchor system 10 includes a support structure 1 adapted to be adjustably mounted to a deck portion of a boat and operable between a storage position (A & B) being substantially upright and an operating position angled below the level of the deck (C). The support structure includes:

a. a base mountable to the deck;

b. a frame;

c. a spinal column in the frame for operably receiving at least a portion of a mast support assembly 2 therein.

The mast support assembly 2 comprises a pair of mast arms pivotally mounted to the support structure, a vertebrae element 5, and intermediate pivotal arms interconnecting the vertebrae element and pair of mast arms, forming a variable geometry frame-like structure.

In assembly, the vertebrae element of the mast support is displaceably received within the spinal column of the support structure. The vertebrae element is linearly displaceable within the spinal column by an actuator piston 4 operably connected thereto mounted on the support structure.

As shown in figures A, B, D, and E, the vertebrae element is displaced linearly downwardly within the spinal column with progressive contraction of the actuator arm. In the uppermost location of the vertebra element within the spinal column, the intermediate arms are folded in a substantially coextending geometry with the spinal column.

As the actuator piston progressively contracts, the vertebrae element is displaced linearly within the spinal column from the uppermost position. As the vertebrae element is displaced away from the uppermost position, the intermediate arms interconnecting the vertebrae element to the pair of mast arms unfold from a coextending position with the spinal column forming a T-shaped geometry with the spinal column of the support structure. Consequently, the mast support changes geometry as the vertebrae is displaced.

As the intermediate arms unfold, as shown, to form a T-shape geometry with the spinal column, the pivotally connected pair of mast arms are displaced outwardly laterally.

The pair of mast arms of the mast support assembly support a sheet material or slatted structure which spans the mast arms and operable between a closed condition (A, B & C) and a fully opened condition (D & E). In one embodiment shown in A and B, there is illustrated a concertina structure mounted by the mast arms in a closed storage condition. The concertina structure comprises a series of shaped slats joined by hinged elements so that each slat is adapted to fold against its neighboring slat element. As the pair of mast arms is displaced outwardly laterally with the change in geometry of the spinal column and vertebrae element to a T-shape configuration, the slatted drogue opens.

The extent to which the drogue element can be opened is controlled by the actuator piston, and the angle of the drogue is also adjustable by a second actuator. So depending on the prevailing conditions, the angle of the drogue is adjustable in the vertical and horizontal planes so that rate and angle of drift can be controlled.

Pivotally located on the support structure, and intermediate arms pivotally connected to the vertebrae element and the mast arms, so that when the vertebrae element is displaced within the spinal column by the actuator arm, the intermediate arms move outwardly laterally of the support structure Interpretation

EMBODIMENTS

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details:

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to a variable geometry anchor for controlling drift of a watercraft.

While these embodiments have been described with emphasis on the embodiments, it should be understood that within the scope of the appended claims, the embodiments might be practiced other than as specifically described herein.

What is claimed is:

1. A variable geometry sea anchor mountable on a watercraft for controlling drift of the watercraft including:

a support structure mountable to a deck portion of the watercraft;

a mast support assembly adjustably mounted to the support structure;

a mast assembly operatively interconnected to the mast support assembly comprising:

a support frame adjustable substantially simultaneously by the mast support assembly in:

a first plane between a storage orientation and an operational orientation, and a second plane between a storage geometry and a drift control geometry;

a web sheet mounted by the support frame, the web sheet being movable by the support frame to provide effective drift control in the drift control geometry;

at least a first actuator mounted on the support structure, and operably connected to the mast support assembly to selectively control the orientation of the support frame of the mast assembly, wherein in a drift control operating condition the at least first actuator acts on the mast support assembly to effect change in the orientation of the support frame in the first plane between the storage and operational orientation, and wherein the support frame changes geometry in the second plane so that the combined support frame and web sheet adopts an operating configuration effective to control drift of the watercraft.

2. A variable geometry sea anchor according to claim 1 wherein the orientation and geometry of the mast assembly is controllable by the mast support assembly so as to minimise deficiencies of twisting of rigging and time taken to redeploy.

3. A variable geometry sea anchor according to claim 1 the support frame comprises a pair of arms mounted to and movably adjustable by the mast support assembly, in which, in a storage orientation, the pair of arms form a unit structure in an upward or vertical position out of the water.

4. A variable geometry sea anchor according to claim 1 wherein in an operating or drift control condition, the pair of arms of the support frame are oriented downwards from the storage orientation into the water and the arms are separated to form a trapezoidal geometry by the adjustable mast support assembly.

5. A variable geometry anchor according to claim 1 wherein in the storage orientation, with the pair of arms abutting to form a unit, the web sheet is substantially folded therebetween and allowed to drain.

6. A variable geometry sea anchor according to claim 1 wherein in the operating or drift control condition, with the pair of arms apart in a trapezoidal geometry, the web sheet extends between the arms thus forming a webbing between the arms for controlling drift.

7. A variable geometry sea anchor mountable on a watercraft for controlling drift of the watercraft including:

a support structure mountable to a deck portion of the watercraft;

a mast support assembly adjustably mounted on the support structure;

a mast assembly comprising:

a support frame comprising a pair of arms mounted to and movably adjustable by the mast support assembly between a storage and operational configuration, and a web sheet mounted by the pair of arms of the support frame, the web sheet being movable between a storage condition and an operating condition by the arms;

a first actuator mounted on the support structure, and operably connected to the mast support assembly to selectively control the mast support assembly, wherein in a drift control operating condition the at least first actuator acts on the mast support assembly to change the orientation of the support frame between a storage and in use position, and wherein the arms of the support frame of the mast assembly changes geometry are reconfigured by the arms so that the web sheet of the mast assembly adopts an operating configuration by the arms effective to control drift of the watercraft.

8. A variable geometry sea anchor according to claim 7 wherein the variable geometry anchor can further include a second actuator operatively connected to the mast assembly wherein the second actuator can operate to change the angle of the web sheet relative to the mast support assembly in the water to further assist drift control.

9. A variable geometry sea anchor according to claim 8 wherein the web sheet further includes a plurality of magnets on an upper edge portion to aid folding of the web sheet when the arms are moved from an operating condition to a storage position.

10. A variable geometry anchor according to claim 9 wherein the support structure can comprise a base plate attachable to a decking portion of the boat, and a pair of arm members fixed to the base plate at an angle.

11. A variable geometry sea anchor according to claim 10 wherein the mast support assembly can comprise a series of interconnected pivot arms pivotally connected at one end to the first actuator and a pivot point on the fixed arm members mounted to the support assembly.

12. A variable geometry sea anchor according to claim 7 wherein the web sheet is fabricated from a neoprene material of about 0.5 mm thickness.

13. A variable geometry sea anchor according to claim 11 wherein the pair of arm members are poles fabricated from a range of materials including aluminium, carbon fibre or fibreglass.

14. A variable geometry sea anchor mountable on a watercraft for controlling drift of the watercraft including:

a support structure mountable to a deck portion of the watercraft;

a mast support assembly adjustably mounted on the support structure;

a mast assembly comprising:

a support frame comprising a pair of arms mounted to and movably adjustable by the mast support assembly between a storage and operational configuration, and a foldable material mounted by the pair of arms of the support frame, wherein in a storage condition the arms abut and the material folded between the arms;

at least a first actuator mounted on the support structure, and operably connected to the mast support assembly to selectively control the mast support assembly, wherein in a first select drift control operating condition the at least first actuator acts on the mast support assembly to change the orientation of the mast assembly between a storage and in use position, and wherein the arms of the mast assembly are separated so that the foldable material of the mast assembly adopts a configuration by the arms effective to control drift of the watercraft.

15. A variable geometry sea anchor mountable on a watercraft for controlling drift of the watercraft including:

a support structure mountable to a deck portion of the watercraft;

a mast support assembly adjustably mounted on the support structure;

a mast assembly comprising:

a support frame comprising a pair of arms mounted to and movably adjustable by the mast support assembly between a storage and operational configuration, and a web sheet mounted by the pair of arms of the support frame, the web sheet being movable between a storage condition and an operating condition by the arms;

a first actuator mounted on the support structure, and operably connected to the mast support assembly to selectively control the mast support assembly;

a second actuator mounted to the operatively connected to the mast assembly wherein the second actuator can operate to change the angle of the web sheet relative to the mast support assembly in the water, to further assist fine drift control;

wherein in a drift control operating condition the at least first actuator acts on the mast support assembly to change the orientation of the support frame between a storage and in use position, and wherein the arms of the support frame of the mast assembly changes geometry are reconfigured by the arms so that the web sheet of the mast assembly adopts an operating configuration by the arms effective to control drift of the watercraft.

16. A variable geometry sea anchor according to claim 7 wherein the web sheet includes internal panels which may include baffles or magnets to aid folding of the web sheet when the arms are moved from an operating condition to a storage position.

17. A variable geometry anchor for controlling drift of a watercraft including:

a support structure;

a mast support assembly pivotally mounted to the support structure, the mast support assembly including a pair of mast arms and a foldable or flexible structure attached to the mast arms, the mast arms being movable between a first storage geometry and an operation geometry;

an open-close sub-system pivotally connected to the support structure and operatively connected to the mast support assembly at fixed pivot mounts on the mast arms;

wherein the open-close subsystem controls the geometry of the mast support assembly such that in a storage orientation the open-close subsystem closes the mast arms substantially together whereby the foldable or flexible structure is received between the mast arms, and in an in use condition the open-close subsystem operatively urges the mast arms apart unfolding and fanning the foldable or flexible structure therebetween.

18. A variable geometry anchor for controlling drift of a watercraft according to claim 17, further including a flip-flop sub-system which is mounted to the support structure and operatively connected to the mast support assembly, the flip flop subsystem being adapted to alter the orientation of the mast support assembly in a separate or combined action to the open close subsystem, from a substantially upright or stored position to a position below the level of the deck of the watercraft.

19. A variable geometry anchor for controlling drift of a watercraft according to claim 17, wherein the open close subsystem comprises a linear actuator and a pivoting arm assembly said arms having one end thereof connected to upper leg portions of the mast support assembly by a pivot mount, and opposite ends of the arms pivotally connected to linear actuator.

20. A variable geometry anchor for controlling drift of a watercraft according to claim 18, wherein the flip flop subsystem includes a linear actuator with piston, the actuator being fixedly mounted at one end to a base support or deck, and a swing arm pivotally attached at one end to the piston and the other end to a pivot mount on a fixed support, the swing arm being further operatively connected to the mast support assembly, wherein the actuator of the flip flop subsystem flips the swing arm in an arcuate pathway and changes the orientation of the mast support assembly.

* * * * *